US006195022B1

(12) United States Patent
Yamakita

(10) Patent No.: US 6,195,022 B1
(45) **Date of Patent: *Feb. 27, 2001**

(54) ACTION ANALYZING/RECORDING SYSTEM

(75) Inventor: Tooru Yamakita, Fussa (JP)

(73) Assignee: Casio Computer Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/934,331

(22) Filed: Sep. 19, 1997

(30) Foreign Application Priority Data

Oct. 7, 1996 (JP) ..... 8-266412

(51) Int. Cl.[7] ..... G08G 1/123
(52) U.S. Cl. ..... 340/988; 340/539; 701/210
(58) Field of Search ..... 340/988, 573.1, 340/573.4, 991, 995, 990, 905, 992, 993, 994, 961, 936, 539; 701/210, 214, 207, 300, 213; 369/25; 707/4, 5, 6, 7; 395/200.42, 200.47; 705/8, 9

(56) References Cited

U.S. PATENT DOCUMENTS

| | | | | |
|---|---|---|---|---|
| 4,750,197 | | 6/1988 | Denekamp et al. | 235/385 |
| 5,289,183 | * | 2/1994 | Hassett et al. | 340/905 |
| 5,335,664 | | 8/1994 | Nagashima | 128/696 |
| 5,473,729 | | 12/1995 | Bryant et al. | 395/2.79 |
| 5,543,789 | * | 8/1996 | Behr et al. | 340/995 |
| 5,731,785 | * | 3/1998 | Lemelson et al. | 342/357 |
| 5,742,666 | * | 4/1998 | Alpert | 340/990 |
| 5,774,070 | * | 6/1998 | Rendon | 340/905 |

FOREIGN PATENT DOCUMENTS

| | | |
|---|---|---|
| 0637807 A2 | 2/1995 | (EP) . |
| 0720137 A2 | 7/1996 | (EP) . |
| 2271486 | 4/1994 | (GB) . |

OTHER PUBLICATIONS

"The Garmin GPS45", Nov. 4, 1995 pp. 1–2.*
"Current IVHS and AVCS Development Status", Oct. 4, 1994, pp. 1–2.*
ARNAV, "R50 Loran", brochure, pp. 1–4, Dec. 1988.*
Database WPI, Section EI, Week 9630, Derwent Publications, Ltd., London, England, Class S02, AN 96–290512 & JP 08 122 093 A (Reem Properties Bv), May 17, 1996.

* cited by examiner

*Primary Examiner*—Brent A. Swarthout
(74) *Attorney, Agent, or Firm*—Frishauf, Holtz, Goodman, Langer & Chick, P.C.

(57) ABSTRACT

The action of a user who is carrying a movable terminal is analyzed in a host terminal. The portable terminal detects the time and position where the portable terminal is present at a predetermined time interval and supplies the pieces of information to the host terminal. The host terminal analyzes the time-serially detected information to recognize the moving locus and the moving speed of the user who is carrying the movable terminal. The host terminal has position information of railway lines and roads as line patterns. By matching processing between the moving locus and the line patterns, the transport facility used by the user for movement is estimated. This invention is to provide a system capable of analyzing/recording a daily action without performing any cumbersome operation.

14 Claims, 18 Drawing Sheets

FIG.9

| A RAILWAY | STATION NAME | SECTION | POSITION | APPROXIMATE CURVE |
|---|---|---|---|---|
| | STATION A | | $(x_A, y_A)$ | |
| | | STATION A - POINT B | | $y = f_b(x)$ |
| | | POINT B - POINT C | | $y = f_c(x)$ |
| | | POINT C - POINT D | | $y = f_d(x)$ |
| | | POINT D - STATION B | | $y = f_B(x)$ |
| | STATION B | | $(x_B, y_B)$ | |
| | ⋮ | | | |
| B RAILWAY ⋮ | | | | |

FIG.13

| TIME | POSITION | ESTIMATION RESULT FOR EACH TIME | ESTIMATION RESULT OBTAINED BY SAMPLING M DATA |
|---|---|---|---|
| ⋮ | ⋮ | ⋮ | ⋮ |
| $T_{i-2}$ | $P_{i-2}$ | STOP | STOP |
| $T_{i-1}$ | $P_{i-1}$ | STOP | STOP |
| $T_i$ | $P_i$ | STOP | STOP |
| $T_{i+1}$ | $P_{i+1}$ | STOP | MOVING |
| $T_{i+2}$ | $P_{i+2}$ | STOP | MOVING |
| $T_{i+3}$ | $P_{i+3}$ | MOVING | MOVING |
| ⋮ | ⋮ | ⋮ | ⋮ |

FIG.16

| | REGISTRATION POSITION | NAME |
|---|---|---|
| | $x_{101}$, $y_{101}$ | STATION A |
| | $x_{102}$, $y_{102}$ | STATION B |
| | ⋮ | |
| USER REGISTRATION DATA | $x_{501}$, $y_{501}$ | HEAD OFFICE |
| | $x_{502}$, $y_{502}$ | BUSINESS OFFICE |
| | $x_{503}$, $y_{503}$ | MR. K'S HOME |
| | ⋮ | |

ACTION ANALYZING/RECORDING SYSTEM

BACKGROUND OF THE INVENTION

The present invention relates to a system for analyzing the action of, e.g., a user who is carrying a portable terminal on the basis of information acquired from the portable terminal.

Information representing the date/time and position of a visit, and in some cases, information of a transport facility used need often be recorded as a daily action record.

In such a case, the user makes a note on the self action in a pocketbook or the like, or inputs the daily action to a personal computer or the like after he/she goes back to the office. In recent years, a portable terminal is becoming popular, and instead of writing the action in the pocketbook, the action record may be sometimes input to the portable terminal.

The operation of writing the daily action record in the pocketbook or inputting it to the personal computer is cumbersome. In addition, the writing or data input operation is often forgotten, so no accurate action record can be made.

BRIEF SUMMARY OF THE INVENTION

It is an object of the present invention to provide a system for automatically analyzing outdoor action and recording it as an action record without performing any cumbersome recording operation.

To achieve the above object, there is provided an action analyzing/recording system wherein information transmitted through a communication control unit of a terminal is analyzed by an information processing unit connected to a network as an action record, data of an analysis result is stored in correspondence with a terminal identification code, and the data is transferred to said terminal as needed, said terminal comprising a detector for detecting position information and time information, and said communication control unit for network connection, and transmitting the information detected by said detector together with the terminal identification code.

According to the present invention, the action of the user who is holding the terminal outdoors can be analyzed, and the means of transportation can be estimated. Therefore, an accurate action can be automatically input without requiring the user of any specific input operation. In addition, since the analyzed data is recorded, the data can be referred to later as a personal action record or record in a goods delivery operation and applied to various application purposes.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

FIG. 9 is a view showing an example of map data stored in the host terminal;

FIG. 13 is a view showing an example of the result obtained by estimating the action of the user who is carrying the portable terminal;

FIG. 16 is a table which stores names on a map and corresponding position information;

DETAILED DESCRIPTION OF THE INVENTION

The embodiment of the present invention will be described below with reference to the accompanying drawing.

Figure 1:
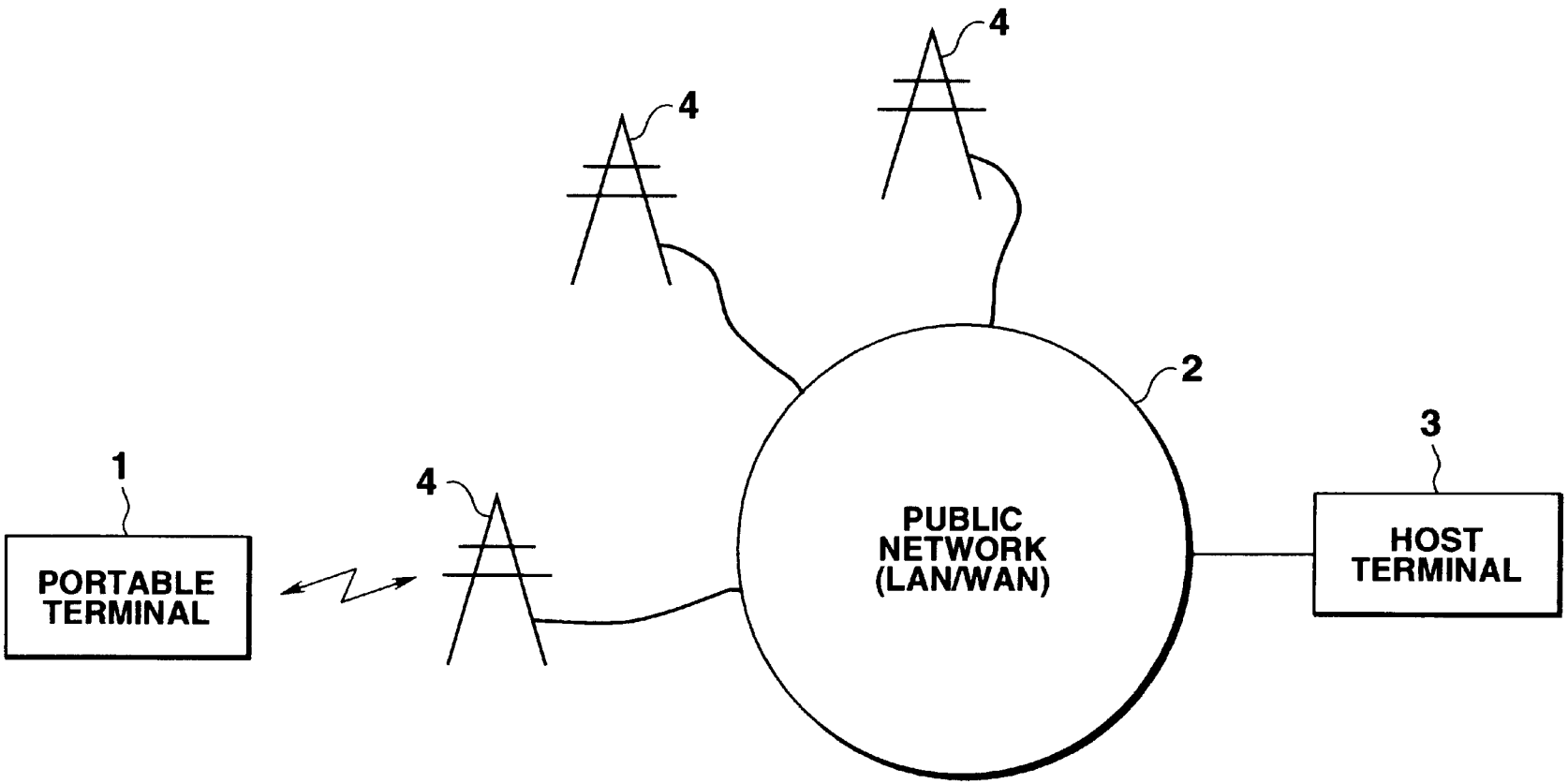
FIG. 1 is a view showing the system configuration of an embodiment.

FIG. 1 is a view showing the system configuration of this embodiment. In this embodiment, a system for analyzing the action of a user having a portable terminal 1 in a host terminal (server machine) 3 accommodated in a public network 2 will be described. Assume that the user is always carrying the portable terminal 1.

The portable terminal 1 detects the position (e.g., aa°bb' north and cc°dd' east) of the portable terminal 1 at a certain time point and this time autonomously or in accordance with an instruction from the portable terminal 1 and supplies the position and time information to the host terminal 3. At this time, the portable terminal 1 is connected to the public network 2 through the nearest base station 4. Upon being notified of the position and time, the host terminal 3 recognizes the position of the user who is carrying the portable terminal 1 at the certain time.

The portable terminal 1 supplies the information (position information and time information) to the host terminal 3 at every predetermined timing. The host terminal 3 analyzes the time-serially detected information, thereby recognizing the moving locus and the moving speed of the user of the portable terminal 1.

Figure 2:
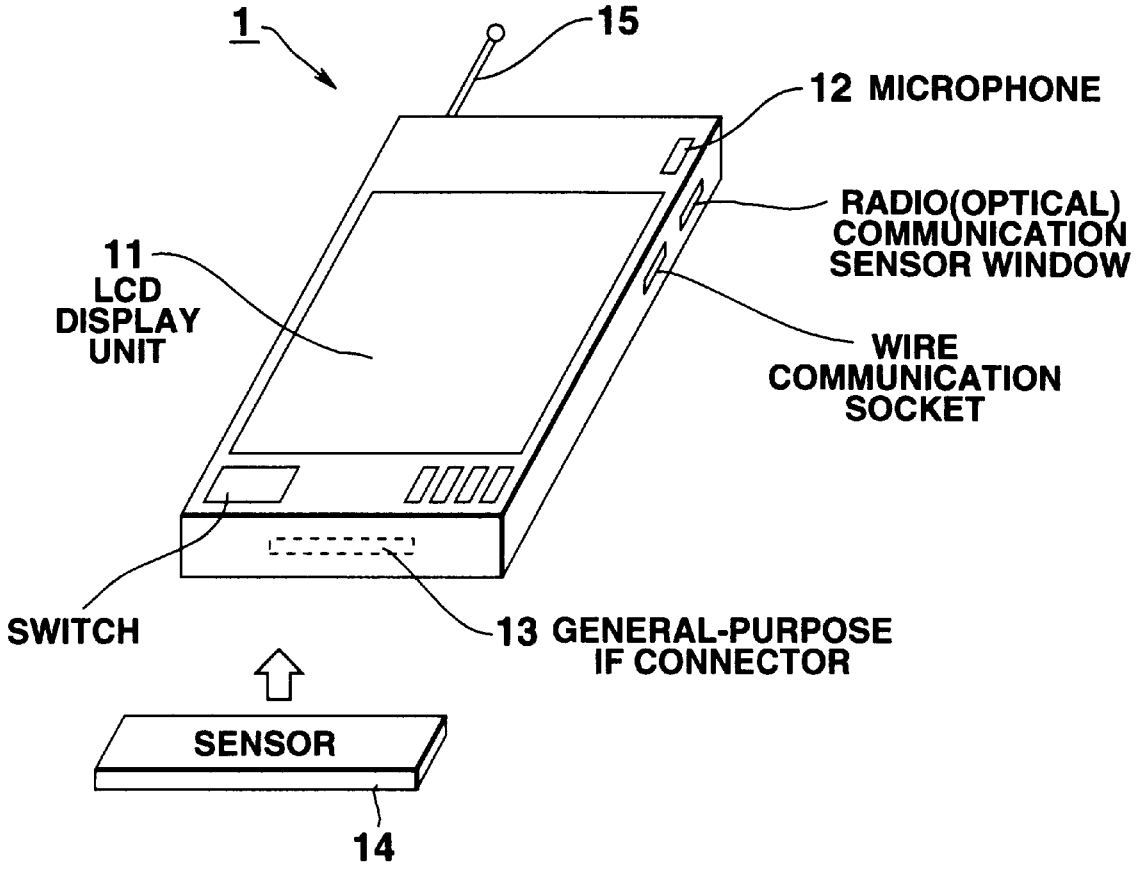
FIG. 2 is a perspective view showing the outer appearance of a portable terminal.

FIG. 2 is a perspective view showing the outer appearance of the portable terminal 1. The portable terminal 1 has an LCD display unit 11, a microphone 12, and a general-purpose IF connector 13. A GPS (Global Positioning System) sensor 14 is connected to the general-purpose IF connector 13. The portable terminal 1 has a radio communication antenna 15.

Figure 3:
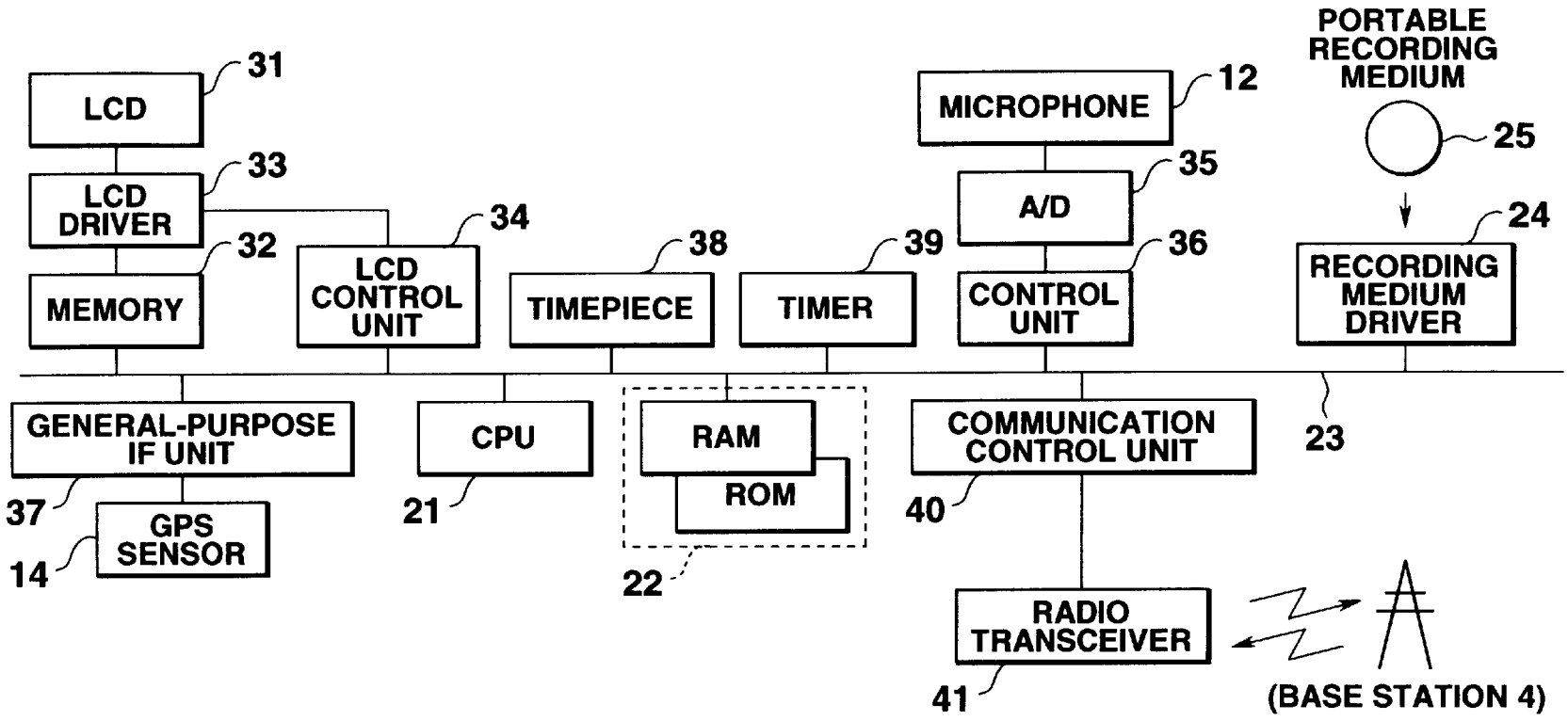
FIG. 3 is a block diagram of the portable terminal.

FIG. 3 is a block diagram of the portable terminal 1. A CPU 21 executes a program stored in a storage unit 22 (ROM and RAM). The CPU 21 and the storage unit 22 are connected via a bus 23.

The storage unit 22 is constituted by a semiconductor memory, a magnetic recording medium, or an optical recording medium and stores the program, data, and the like. The storage unit 22 may be permanently incorporated or detachably mounted in the portable terminal 1.

A recording medium driver 24 is connected to the bus 23 to read out data stored in a portable recording medium (including a semiconductor memory, a magnetic disk, an optical disk, and a magnetooptical disk) 25 or write data in the portable recording medium 25. An IC card is assumed as an example of the portable recording medium 25. The CPU 21 can also execute a program stored in the portable recording medium 25.

The program and data to be recorded in the storage unit 22 may be received from another device connected through a communication line or the like, and recorded. Alternatively, the CPU 21 may use, through the communication line or the like, a program and data stored in a storage unit arranged on the another device side.

A unit corresponding to the LCD display unit 11 comprises a liquid crystal display (LCD) 31, a memory 32 for storing information to be displayed on the liquid crystal display 31, an LCD driver 33 for outputting information stored in the memory 32 to the liquid crystal display 31 under the control of an LCD control unit 34, and the LCD control unit 34 for controlling the memory 32 and the LCD driver 33.

An A/D converter 35 converts sound information acquired through the microphone 12 into digital data. A sound information control unit 36 outputs the sound information A/D-converted by the A/D converter 35 to the bus 23. The sound information control unit 36 has a function of compressing sound information.

The GPS sensor 14 detects the current position by communicating with, e.g., an artificial satellite. A general-purpose IF unit 37 outputs detected data from the GPS sensor 14 to the bus 23 in accordance with an instruction from the CPU 21. A timepiece 38 counts time. A timer 39 interrupts the CPU 21 at a predetermined time interval.

In sending data, a communication control unit 40 prepares a transmission packet and transfers the packet to a radio transceiver 41 in accordance with an instruction from the CPU 21. In receiving data, the communication control unit 40 outputs data stored in a packet received through the radio transceiver 41 onto the bus 23. The radio transceiver 41 is connected to the radio communication antenna 15 shown in FIG. 2 to transmit/receive data to/from the base station 4.

Figure 4:
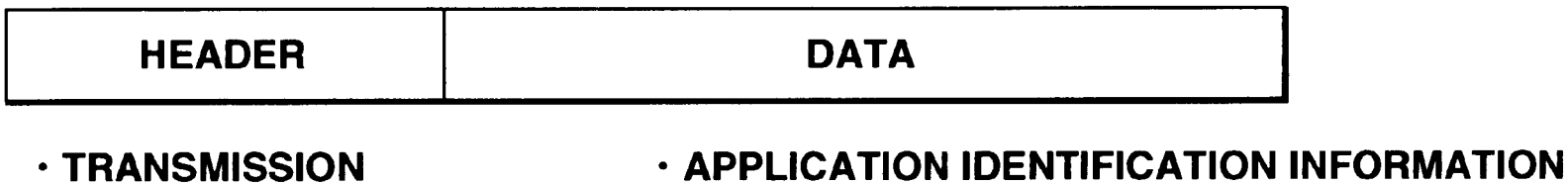
FIG. 4 is a view showing the structure of a packet sent from the portable terminal.

FIG. 4 is a view showing the structure of a packet sent from the portable terminal 1. Each packet is constituted by a header portion and a data portion. The header portion stores a transmission source address, a transmission destination address, and the like. The address system containing an address to be stored as a transmission source address or a transmission destination address is determined depending on the network structure to which this embodiment is applied. In, e.g., TCP/IP communication, an IP address is stored.

The data portion stores application identification information, a command, position information, time information, and sound information. The application identification information is used to identify an application program to be started on a destination terminal (host terminal 3 in this embodiment). In this embodiment, information for identifying an action analysis program is set. Note that, in TCP/IP communication, the application identification information is designated as a port number.

The command is instruction information for the terminal (host terminal 3) designated by the transmission destination address and is interpreted on an application designated by application identification information. In this embodiment, an action analysis command or an analysis result request command is used.

The position information represents the position of the portable terminal 1 and corresponds to the position of the user who is carrying the portable terminal. This position information is sequentially prepared on the basis of the output from the GPS sensor 14. The time information represents time when the position information, i.e., the output from the GPS sensor 14 is detected, and corresponds to the output from the timepiece 38. The sound information is sound data acquired through the microphone 12 at the timing when the position information is detected. In this embodiment, sound information is acquired as ambient information of the portable terminal 1. However, a temperature sensor or a camera may be arranged to acquire temperature or image information as ambient information.

Figure 5:
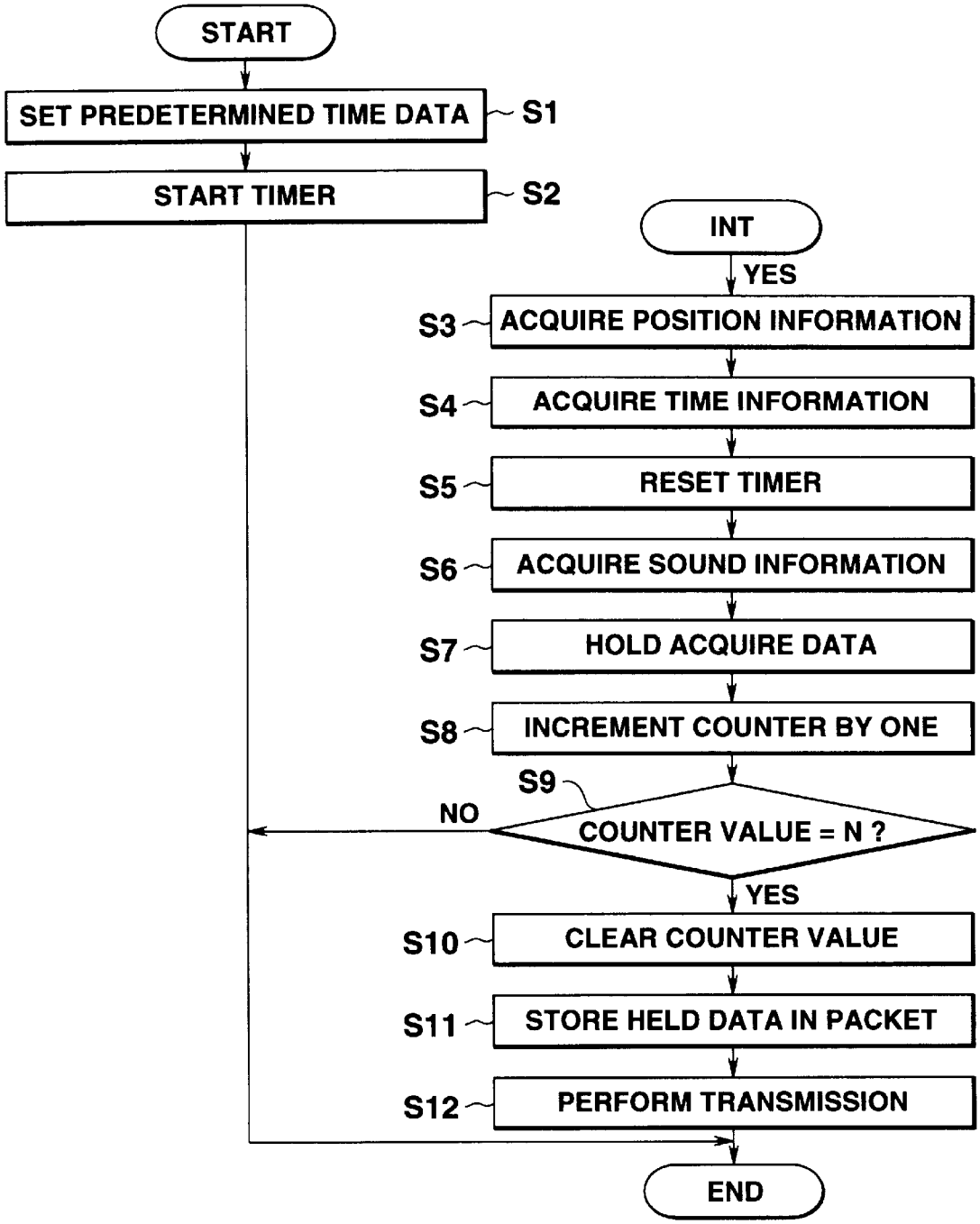
FIG. 5 is a flow chart of an operation of preparing a packet from data acquired by the portable terminal and sending the packet.

FIG. 5 is a flow chart of an operation of preparing a packet from data acquired by the portable terminal and sending the packet. The program for realizing the functions of this flow chart is stored in the storage unit 22 as a form of program code which can be read by the CPU 21. In this processing, the portable terminal 1 acquires position information, time information, and sound information N times at a predetermined time interval, transfers all the acquired information to the host terminal 3, and requests action analysis processing. Assume that the portable terminal 1 is always executing the program for acquiring position information, time information, and sound information while the power is ON.

In steps S1 and S2, predetermined time interval data is set for the timer 39, and the timer 39 is started. When the timer 39 has counted a predetermined time (e.g., one minute), an interrupt signal is input to the CPU 21 via the bus 23, so that processing from step S3 is executed.

In step S3, the output (position information) from the GPS sensor 14 is acquired. In step S4, the time (time information) counted by the timepiece 38 is acquired. In step S5, the timer 39 is reset. In step S6, ambient sound data (e.g., noise) collected through the microphone 12 is acquired. This sound collection processing is performed for, e.g., 5 seconds. The timer 39 is reset and starts the time counting operation again.

In step S7, the information acquired in steps S3, S4, and S6 are temporarily held in the RAM in the storage unit 22. In step S8, a counter (not shown) is incremented by one. In step S9, the count value of the counter is checked. If the count value has reached "N (N: positive integer)", the flow advances to step S10. If the count value has not reached N, the flow returns to step S2 (to wait for the next interrupt signal from the timer 39). In step S10, the count value of the counter is cleared.

In step S11, the packet shown in FIG. 4 is prepared. The addresses of the portable terminal 1 and the host terminal 3 are set as a transmission source address and a transmission destination address, respectively. As application identification information and a command, an "action analysis program" and an "action analysis command" are set. As position information, time information, and sound information, the pieces of information acquired in steps S3, S4, and S6 are read out from the storage unit 22 and stored in the packet. The position information, time information, and sound information to be stored are data acquired N times. In step S12, the packet prepared in step S11 is output by radio. The packet is transferred to the host terminal 3 in accordance with the transmission destination address set in the header portion.

In the above embodiment, all the acquired data corresponding to N cycles are transferred from the portable terminal 1 to the host terminal 3 to reduce the transmission cost. However, the data may be transferred when the acquired data reaches a predetermined capacity. Alternatively, position information, time information, or sound information may be transferred to the host terminal 3 every time the information is acquired. In the above embodiment, the flow chart shown in FIG. 5 is autonomously executed by the portable terminal 1. Alternatively, the processing of transmitting the packet to the host side may be executed in accordance with a starting instruction which is regularly transmitted from the host terminal 3.

Figure 6:
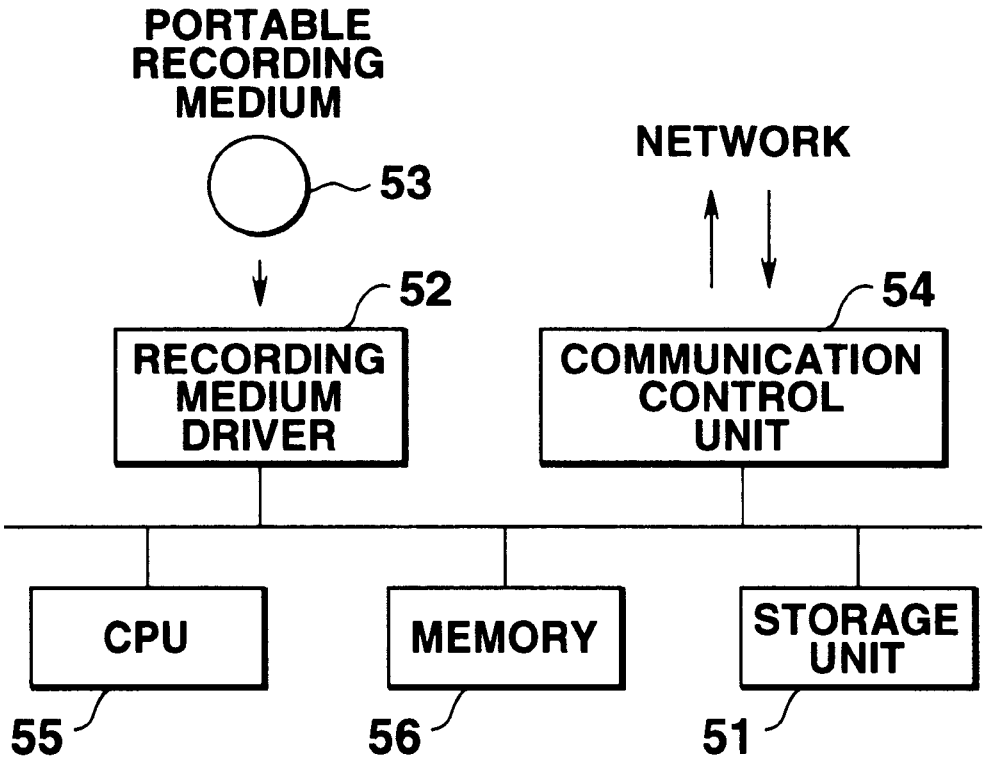
FIG. 6 is a block diagram showing the arrangement of a host terminal.

FIG. 6 is a block diagram of the host terminal 3. A storage unit 51 is constituted by a semiconductor memory, a magnetic recording medium, or an optical recording medium and stores a program, data, and the like. The storage unit 51 may be permanently incorporated or detachably mounted in the host terminal 3.

A recording medium driver 52 reads out data stored in a portable recording medium (including a semiconductor memory, a magnetic disk, an optical disk, and a magnetooptical disk) 53 or writes data in the portable recording medium 53. A communication control unit 54 controls data transmission/reception to/from the network. Packet transmission/reception to/from each portable terminal is also controlled by the communication control unit 54.

A CPU 55 loads the program from the storage unit 51 or the portable recording medium 53 and executes the program. The program and data recorded in the storage unit 51 may be written from the portable recording medium 53 or received from another device on the network through the communication line or the like and recorded. The CPU 55 may use a program and data stored in another storage unit arranged on the network through the communication line or the like.

Figure 7:
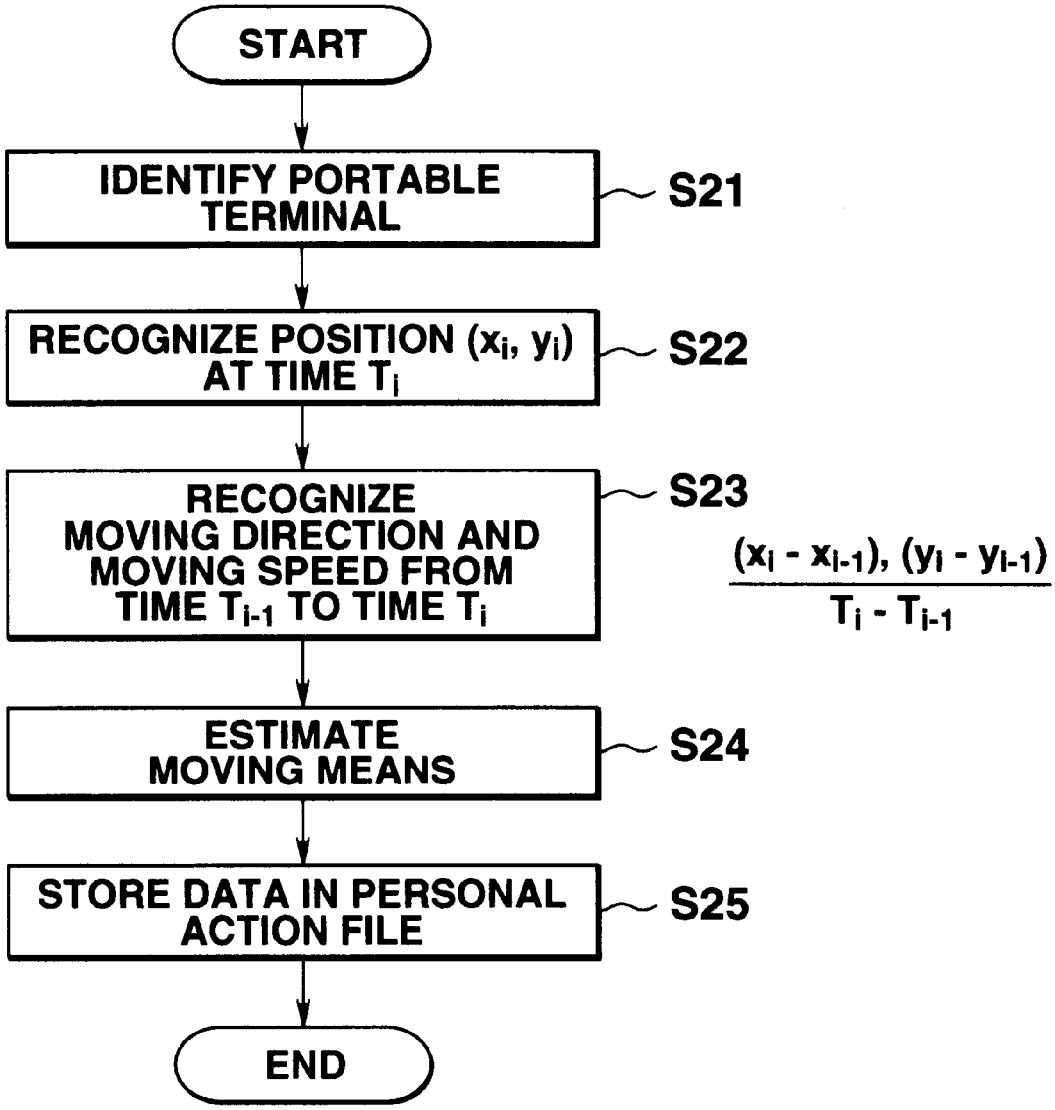
FIG. 7 is a flow chart for explaining processing in the host terminal.

FIG. 7 is a flow chart for explaining processing in the host terminal 3. In this example, a packet sent from the portable terminal 1 (packet prepared with processing of the flow chart shown in FIG. 5) is received to analyze the action of the user who is carrying the portable terminal 1.

In step S21, the transmission source address stored in the header portion of the received packet is checked to recognize the transmission terminal. In this case, the transmission terminal is assumed to be the portable terminal 1. The application identification information and the command are checked. In this case, assume that an "action analysis program" and an "action analysis command" are set.

In step S22, position information and time information, which are stored in the data portion of the received packet, are extracted to recognize the position $(x_i, y_i)$ of the portable terminal 1 at time $T_i$. In step S23, the moving direction and moving speed of the portable terminal 1 from time $T_{i-1}$ to time $T_i$ are calculated.

In step S24, the calculation result obtained in step S23 is used to estimate the moving means (walking, train, motor vehicle, stop, . . . ) of the user who is carrying the portable terminal 1. More specifically, the position of the user who is carrying the portable terminal 1 at a certain time point, and if he/she is moving, the moving means are estimated. In this processing of estimating the moving means, sound information stored in the data portion of the received packet is used, as needed. In step S25, the estimation result obtained in step S24 is stored in the personal action file of the user who is carrying the portable terminal 1.

Figure 8:
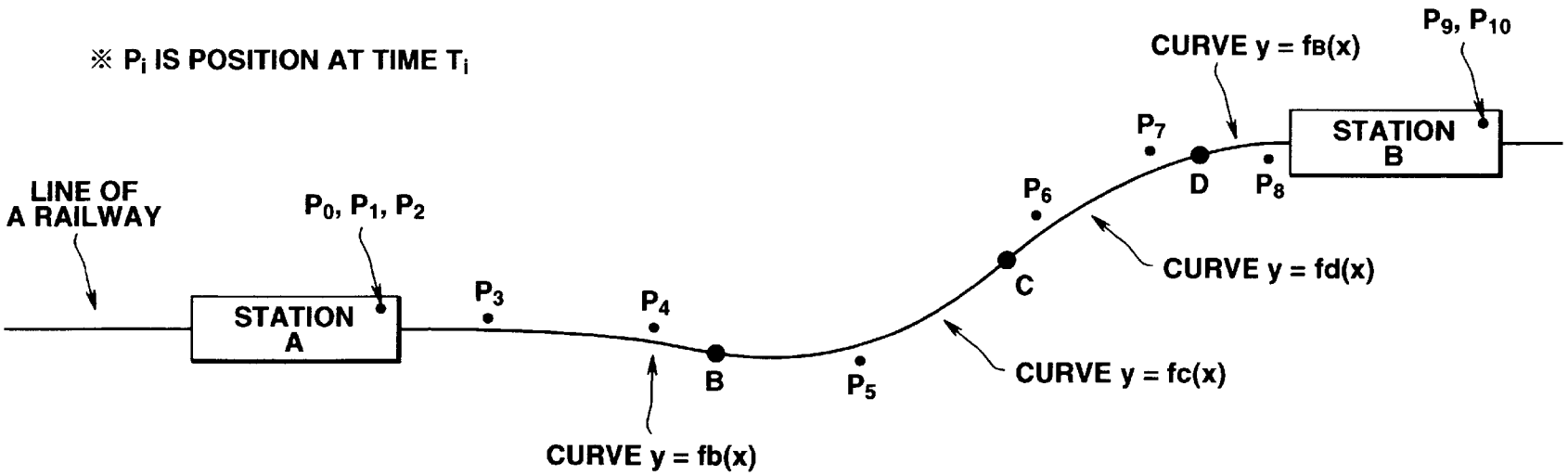
FIG. 8 is a view showing an example of the moving route of a user who is carrying the portable terminal.

The operation of the flow chart shown in FIG. 7 will be described below in more detail. A case wherein the user who was carrying the portable terminal 1 moved from station A to station B by A railway, as shown in FIG. 8, will be described.

Upon receiving an action recording start command from a key input means (not shown) of the portable terminal 1, or the host terminal 3, the portable terminal 1 executes the processing of the flow chart shown in FIG. 5 and detects the output from the GPS sensor 14 at time $T_0, T_1, T_2 \ldots, T_{10}$. The detected pieces of position information correspond to position data $P_0, P_1, P_2, \ldots, P_{10}$. In detecting the position information, the portable terminal 1 fetches sound information acquired through the microphone 12. For example, it is estimated that, in a station, various types of noise are detected, and in a train, sounds unique to the train are detected. The portable terminal 1 transfers the detected position information, time information, and sound information to the host terminal 3. Since the data detected by the GPS sensor 14 have errors, points designated by the position information (position data $P_0, P_1, P_2, \ldots, P_{10}$) do not always match the line.

Upon receiving the information transferred from the portable terminal 1, the host terminal 3 executes the processing of the flow chart shown in FIG. 7 to analyze the moving route of the user who is carrying the portable terminal 1. For the purpose of analyzing the route, the host terminal 3 has map data as shown in FIG. 9. FIG. 9 shows part of the position information of the line of A railway (position information of the line between station A and station B) as an example.

As shown in FIG. 9, pieces of information representing the positions of stations (in this case, station A and station B) are stored. The position information of the line is stored as approximate curves of the line. In this example, the line between station A and station B is divided into four sections, and an approximate curve equation is defined for each section.

The host terminal 3 also stores map data associated with all railways. Not only data associated with railways but also data associated with roads are stored in the host terminal 3. These map data are stored in, e.g., the storage unit 51 and loaded in the memory 56 as a reference, as needed.

Figure 10:
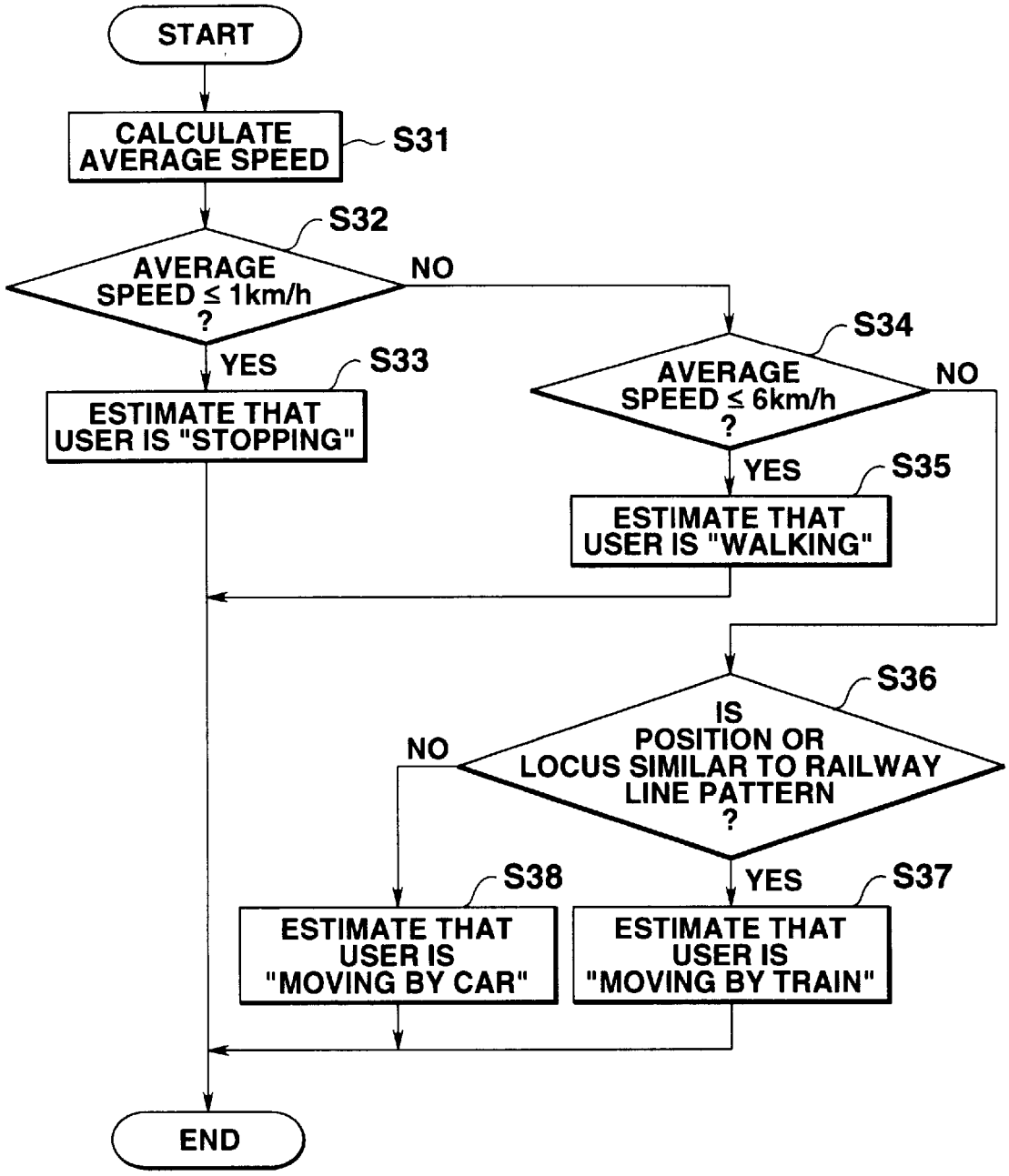
FIG. 10 is a flow chart (1) of processing of estimating the action of the user who is carrying the portable terminal.

FIG. 10 is a flow chart (1) for explaining processing of estimating the action of the user who is carrying the portable terminal 1. This processing corresponds to steps S23 and S24 in FIG. 7.

In step S31, the average moving speed of the user who is carrying the portable terminal 1 is calculated. More specifically, the average moving speed of the portable terminal 1 from time $T_{i-1}$ to time $T_i$ is calculated according to the following formula. At this time, the moving direction is simultaneously calculated:

$$\frac{\sqrt{(x_i - x_{i-1})^2 + (y_i - y_{i-1})^2}}{|T_i - T_{i-1}|}$$

In step S32, it is checked whether the speed calculated in step S31 is 1 km/h or less. If YES in step S32, it is estimated in step S33 that the user is "stopping". If NO in step S32, the flow advances to step S34.

In step S34, it is checked whether the speed calculated in step S31 is 6 km/h or less. If YES in step S34, it is estimated in step S35 that the user is "walking". If NO in step S34, the flow advances to step S36.

In step S36, it is checked whether the moving locus of the user who is carrying the portable terminal 1 is similar to the railway line pattern stored as map data. In this case, distances from the points designated by position data $P_0$, $P_1$, $P_2$, . . . , $P_{10}$ to the curves represented by the curve equation representing the railway line are calculated by, e.g., the method of least squares, and determination is made on the basis of whether each calculated value is equal to or smaller than a predetermined value. Alternatively, determination is made on the basis of the similarity between a locus drawn by at least two position data and a curve pattern representing the railway line. Determination in this step is performed using a known technique, and a detailed description thereof will be omitted.

If the moving locus of the user who is carrying the portable terminal 1 is similar to the line pattern, it is estimated in step S37 that the user is "moving by train". If the moving locus is not similar to the line pattern, it is estimated in step S38 that the user is "moving by motor vehicle (automobile or bus)".

The estimation result obtained in this way is held in a predetermined area on the memory 56 as data of action (movement situation) of the user who is carrying the portable terminal 1 at a certain time point. The host terminal 3 sequentially stores the estimation result data at each time (time when the position information and the like are detected by the portable terminal 1).

Figure 11:
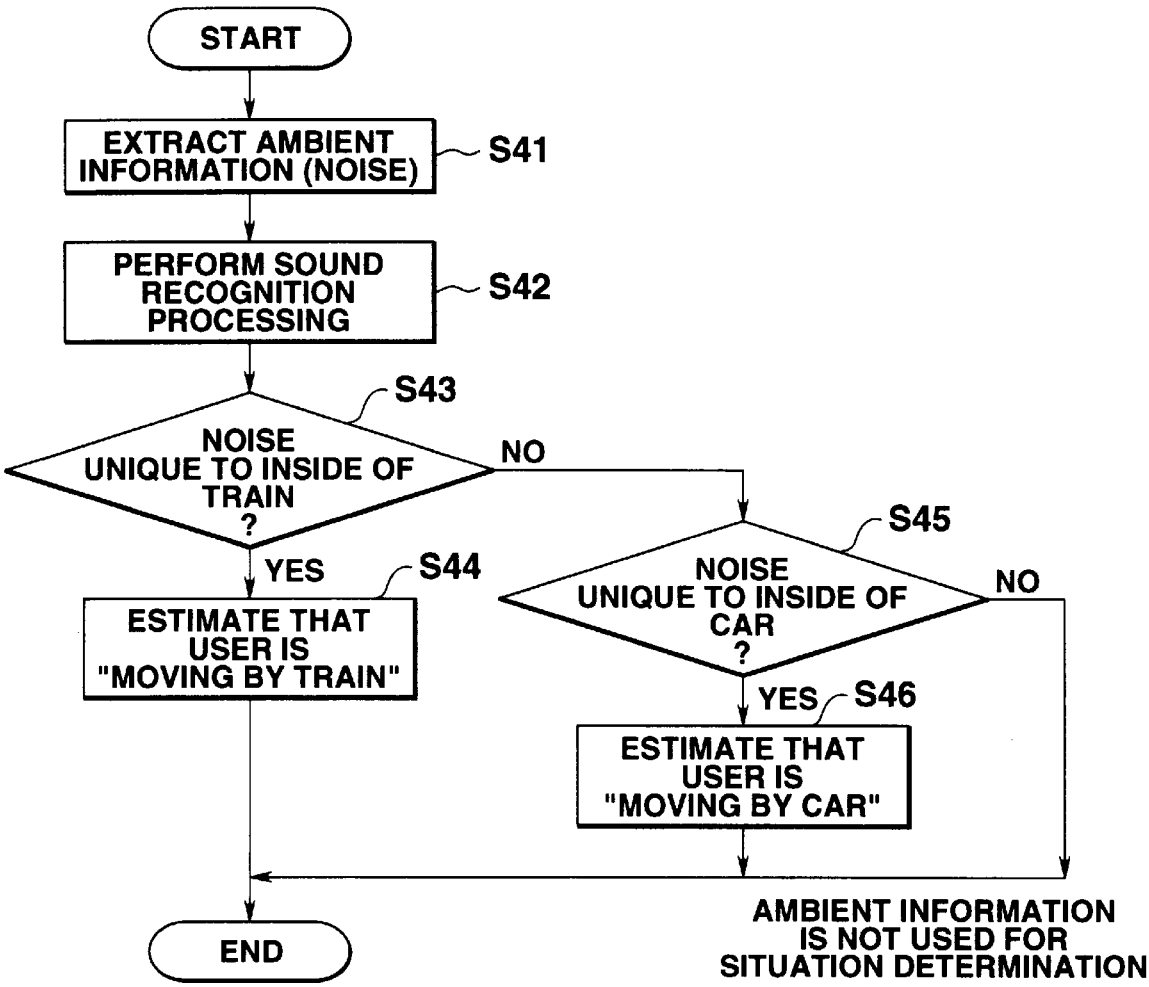
FIG. 11 is a flow chart (2) of processing of estimating the action of the user who is carrying the portable terminal.

FIG. 11 is a flow chart (2) for explaining processing of estimating the action of the user who is carrying the portable terminal 1. This processing corresponds to step S24 in FIG. 7 and is executed parallel to the processing shown in FIG. 10.

In step S41, sound information stored in the packet transferred from the portable terminal 1 is extracted. In step S42, the sound information is analyzed to recognize the characteristic features of the sound information. In step S43, it is checked whether the sound information analyzed in step S42 includes unique sounds generated in a running train. If YES in step S43, it is estimated in step S44 that the user is "moving by train". If NO in step S43, the flow advances to step S45.

In step S45, it is checked whether the sound information analyzed in step S42 includes unique sounds generated in a running motor vehicle or bus. If YES in step S45, it is estimated in step S46 that the user is "moving by motor vehicle". If NO in step S45, the sound information is discarded in this estimation processing.

The host terminal 3 holds in advance a unique sound pattern generated in a running train and a unique sound pattern generated in a running automobile or bus. In step S43 or S45, the similarity between the sound information extracted in step S41 and the held pattern is determined.

The estimation result obtained by processing of the flow chart shown in FIG. 11 is used as information for increasing the likelihood ratio of the estimation result obtained by processing of the flow chart shown in FIG. 10.

Figure 12:
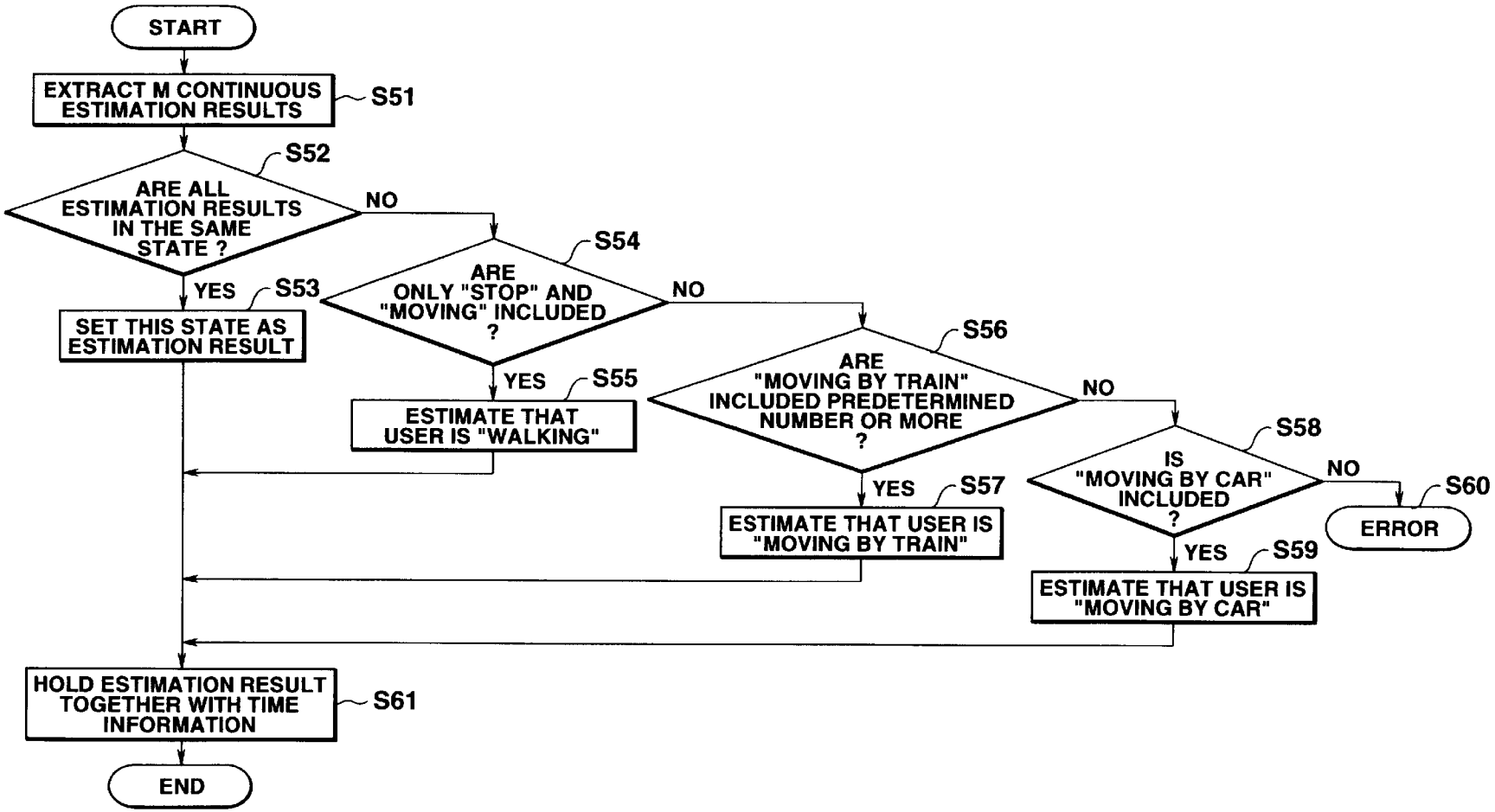
FIG. 12 is a flow chart (3) of processing of estimating the action of the user who is carrying the portable terminal.

FIG. 12 is a flow chart (3) for explaining processing of estimating the action of the user who is carrying the portable terminal 1. In this processing, a plurality of estimation results are obtained by processing of the flow charts shown in FIGS. 10 and 11, and the action of the user who is carrying the portable terminal 1 is estimated at a higher likelihood ratio on the basis of these pieces of information.

In step S51, M estimation results obtained by processing of the flow charts shown in FIGS. 10 and 11 are extracted. When M=5, and the action at times $T_i$ is to be estimated, estimation results at time $T_{i-2}$, $T_{i-1}$, $T_i$, $T_{i+1}$, and $T_{i+2}$ are extracted.

In step S52, it is checked whether all the M estimation results extracted in step S51 are in the same state. If YES In step S52, the estimation results are regarded as an estimation result having a higher likelihood ratio. The flow advances to step S61 to hold the result together with the position information and the time information. Assume that all the estimation results obtained by processing of the flow chart shown in FIG. 10 at times $T_{i-2}$, $T_{i-1}$, $T_i$, $T_{i+1}$, and $T_{i+2}$ are "stop", the host terminal 3 estimates that the user who is carrying the portable terminal 1 is stopping at the position represented by the position information at that time, and stores the estimation result in the memory 56 or the storage unit 51.

If it is determined in step S52 that the estimation results are different, it is checked in step S54 whether the M estimation results include only "stop" and "walking". If YES in step S54, it is estimated in step S55 that the user who is carrying the portable terminal 1 is "walking". The flow advances to step S61 to hold the estimation result together with the position information and the time information.

If, in step S54, the estimation results include estimation results other than "stop" and "walking", it is checked in step S56 whether a predetermined number or more of estimation results "moving by train" are included. If YES in step S56, it is estimated in step S57 that the user who is carrying the portable terminal 1 is "moving by train". The flow advances to step S61 to hold the estimation result together with the position information and the time information.

If NO in step S56, it is checked in step S58 whether "moving by motor vehicle (automobile or bus)" is included. If YES in step S58, it is estimated in step S59 that the user who is carrying the portable terminal 1 is "moving by motor vehicle". The flow advances to step S61 to hold the estimation result together with the position information and the time information. If NO in step S58, error processing is executed in step S60.

With the above procedure, estimation results as shown in FIG. 13 are obtained. The algorithm for estimating the action of the user who is carrying the portable terminal 1 is not limited to the above algorithm, and another method may be used.

Figure 14:
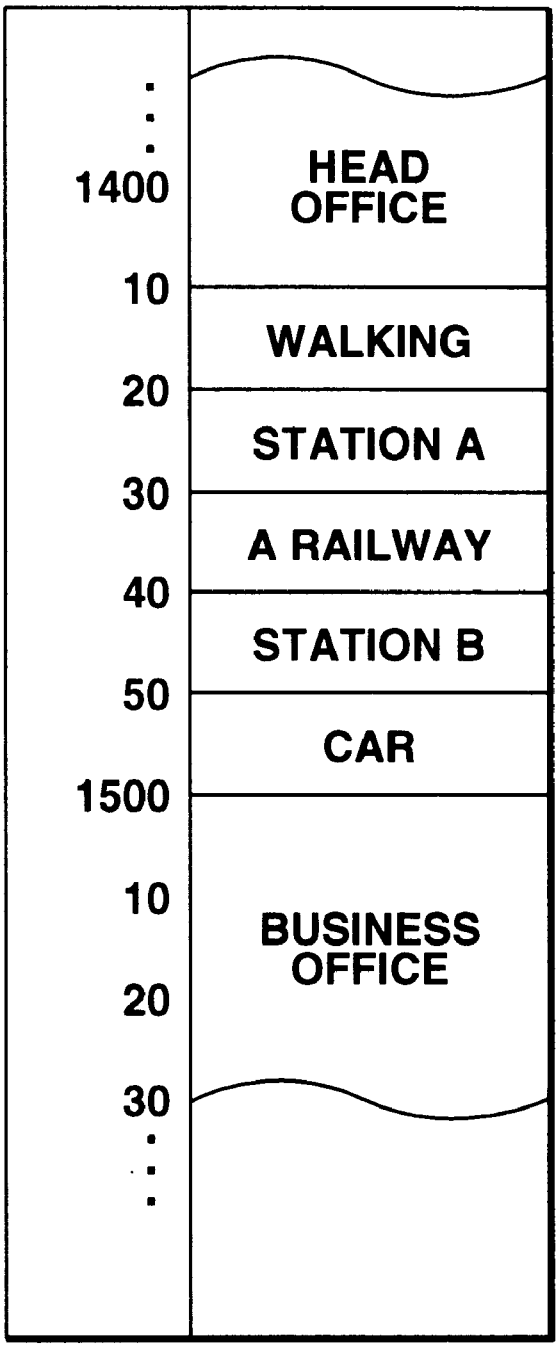
FIG. 14 is a view showing an example of an action record table of the user who is carrying the portable terminal.
Figure 15:
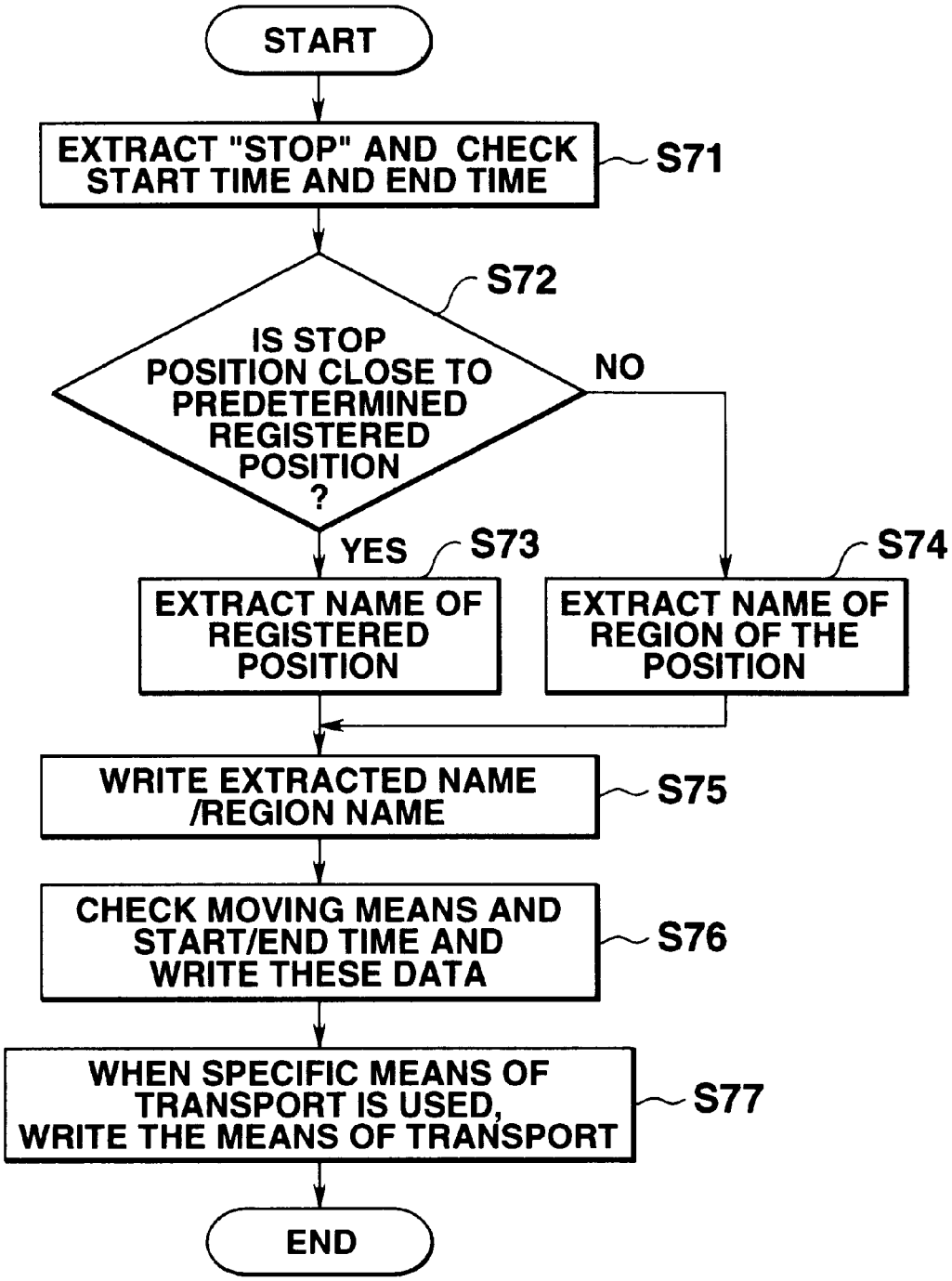
FIG. 15 is a flow chart of processing of preparing the action record table of the user who is carrying the portable terminal.

A procedure of preparing an action record table as shown in FIG. 14 will be described. FIG. 15 is a flow chart of processing of preparing the action record table of the user who is carrying the portable terminal 1.

In step S71, "stop" is extracted from the estimation results shown in FIG. 13, and the start time and end time are checked. The position information is also extracted. In step S72, it is checked whether the stop position extracted in step S71 is a position registered in advance. For this determination, the host terminal 3 refers to a table shown in FIG. 16. The table shown in FIG. 16 stores various names on the map and corresponding position information. Railway stations and other public facilities are registered in advance. In addition, the user can register a desired location. In this embodiment, "head office", "business office", "Mr. K's house", . . . are registered.

If YES in step S72, the name of the registration position is extracted in step S73. If NO in step S72, the region name of the position (e.g., xx Prefecture xx City xx) is extracted in step S74. Note that the host terminal 3 has a table storing region names and corresponding position information.

In step S75, the registration position name extracted in step S73 or the region name extracted in step S74 is written for the time zone of "stop" recognized in step S71. Assume that the user who was carrying the portable terminal 1 was in the head office before 14:10. In this case, the position information detected by the portable terminal 1 before 14:10 must be equal or approximate to position data $(x_{501},y_{501})$ registered in the table shown in FIG. 16. The position information detected by the portable terminal 1 is transferred to the host terminal 3 and stored in the table shown in FIG. 13. In processing in steps S72 through S74, the host terminal 3 recognizes that the user who was carrying the portable terminal was in the head office before 14:10 because the position information detected by the portable terminal 1 is equal or approximate to the position data registered as the position of the head office. As a result, "head office" is written for the time zone before 14:10, as shown in FIG. 14.

In step S76, the moving means (walking, train, automobile, or bus) represented by the above-described estimation result and the start time and end time of movement using the moving means are checked. As shown in FIG. 14, the moving means is written for each time zone. When a specific means of transportation is used, the means of transportation is written in step S77. Assume that it is estimated from the similarity to the railway line pattern stored as map data shown in FIG. 9 that the user who was carrying the portable terminal moved from station A to station B by A railway, "A railway" is written as a moving means, and region names "station A" and "station B" are written as a starting point and a terminal point, respectively.

The action record table prepared in the above way is stored in a predetermined area in the storage unit 51 of the host terminal 3. When the user who is carrying the portable terminal 1 is to display the action record table on the portable terminal 1, a packet for requesting display of the action record table is sent from the portable terminal 1. The request packet has the structure shown in FIG. 4. The addresses of the portable terminal 1 and the host terminal 3 are set as a transmission source address and a transmission destination address, respectively. An "action analysis program" is set as application identification information, and an "analysis result request command" is set as a command. A date to be referred to is added as additional information of the command. The command and the additional information of the command are input by the user using, e.g., a pen input method from the LCD display unit 11 of the portable terminal 1.

Upon receiving the command having the "analysis result request command" from the portable terminal 1, the host terminal 3 interprets the command and extracts the action record table of the user who is carrying the portable terminal 1 at the designated date. The extracted action record table is stored in a packet and transferred to the portable terminal 1. The portable terminal 1 extracts the action record table from the packet transferred from the host terminal 3 and displays it on the LCD display unit 11.

The processing programs executed by the host terminal 3, i.e., programs for realizing the functions of the flow charts shown in FIGS. 7, 10, 11, 12, and 15, and the program for interpreting a command transferred from the portable terminal 1 and processing the command are stored in the storage unit 51 or the portable recording medium 53 in the form of program codes which can be read by the CPU 55. Alternatively, programs stored in another device connected through the network are used.

As described above, in the action analyzing system of this embodiment, position information and time information are detected by the portable terminal 1 and transferred to the host terminal 3, and the action record of the user who is carrying the portable terminal 1 is automatically prepared on the host side. For this purpose, the portable terminal 1 need have only a function of detecting position information and time information and transferring them to the host terminal 3, a function of requesting the host terminal 3 of an action record, and a function of displaying data downloaded from the host terminal 3. That is, the portable terminal 1 need neither store an enormous quantity of map data nor execute highly precise pattern recognition processing or various processing which require high-speed processing. For this reason, the portable terminal 1 can obtain an advanced action analysis result without requiring any large-capacity memory or high-performance processor.

In the above embodiment, position information and time information are detected by the portable terminal 1 at a predetermined timing. However, the present invention is not limited to this arrangement. Generally, the user of the movable terminal is not always moving and can be considered to stop at a certain position for most of time. If the user of the portable terminal stops at a certain position for a predetermined time or more, position information need not be detected every predetermined time, and not all the position information need be supplied from the portable terminal 1 to the host terminal 3.

Figure 17:
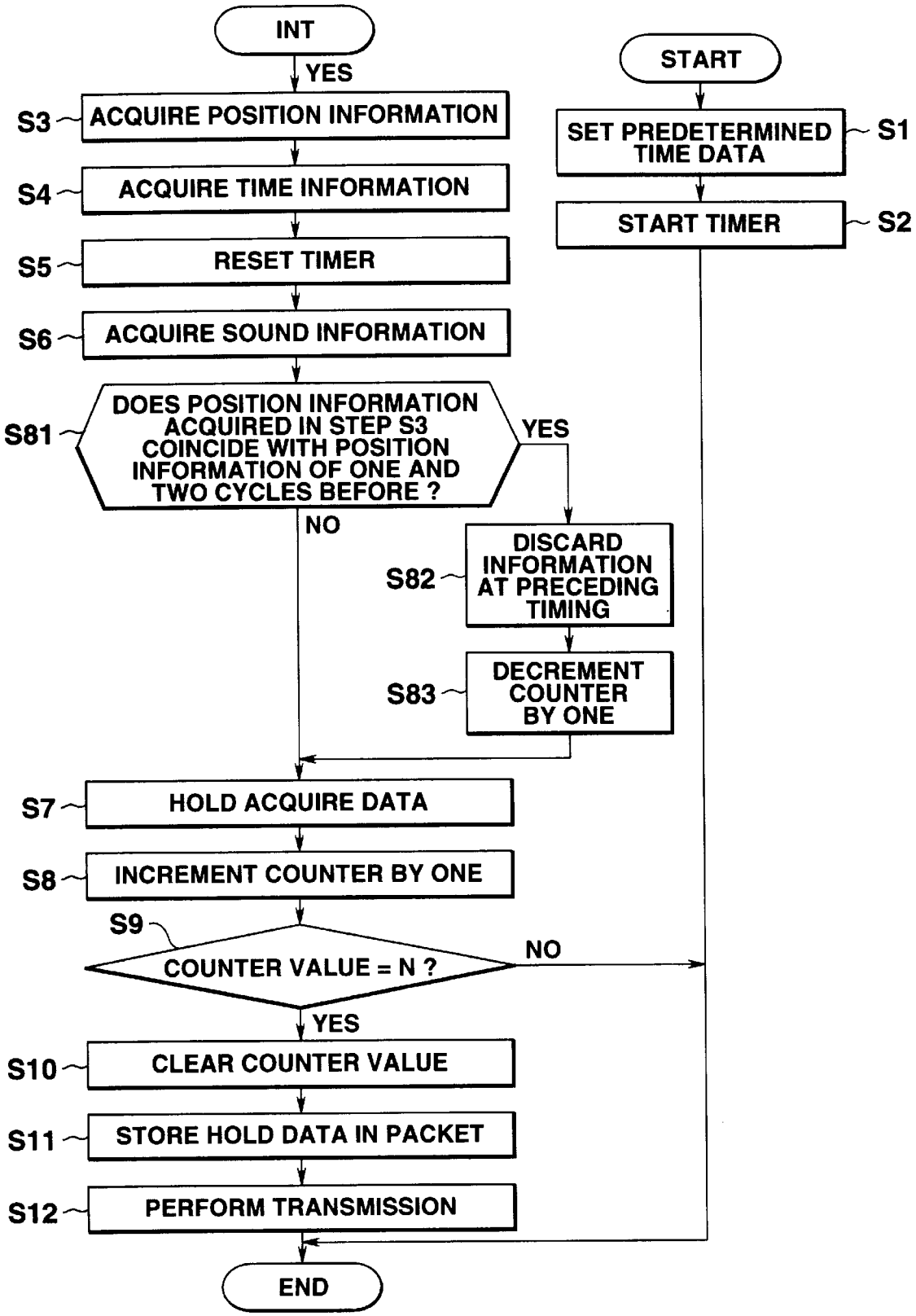
FIG. 17 is a flow chart of an operation of preparing a packet from data acquired by the portable terminal and sending the packet.

FIG. 17 is a flow chart showing an operation of preparing a packet from data acquired by the portable terminal 1 and sending the packet. This processing procedure is obtained by adding steps S81 through S83 to the flow chart shown in FIG. 5.

In step S81, it is checked whether the position information obtained in step S3 coincides with position information of one and two cycles before. If NO in step S81, the flow advances to step S7 to continue the processing in FIG. 5. If YES in step S81, the position information, time information, and sound information at the preceding timing are discarded in step S82. In step S83, the counter which is to be incremented by one in step S8 is decremented by one.

Processing of the flow chart shown in FIG. 17 will be described in more detail. A case wherein the user who was carrying the movable terminal 1 was continuously present at position $P_0$ and time $T_1$ through time $T_4$ (times detected in step S4) will be described.

"Position $P_0$" is detected by position detection at time $T_1$ and time $T_2$, and these data are held in step S7. At time $T_3$, "position $P_0$" is detected again. In step S81, the position data at time $T_3$ coincides with position data of one (time $T_2$) and two (time $T_1$) cycles before. The flow advances to step S82 to discard the position information, time information, and sound information acquired at the preceding timing (time $T_2$). Thereafter, the position data at time $T_3$ is held in step S7. As a result, only the pieces of information acquired at time $T_1$ and time $T_3$ are held.

"Position $P_0$" is detected at time $T_4$ again. Since, in step S81, position data at time $T_4$ coincides with position data of one (time $T_3$) and two (time $T_1$) cycles before, the flow advances to step S82 to discard position information, time information, and sound information acquired at the preceding timing (time $T_3$). At this time point, the information at time $T_2$ have been discarded, and time $T_1$ corresponds to the timing of "two cycles before". Thereafter, the position data at time $T_4$ is held in step S7. As a result, only the pieces of information acquired at time $T_1$ and time $T_4$ are held.

As described above, when the user who was carrying the movable terminal 1 continuously stayed at a certain position for a predetermined time or more, only position information, time information, and sound information at the start and end of "stop" are held and transferred to the host terminal 3. With this arrangement, transfer of redundant information (in the above example, information acquired at time $T_2$ and time $T_3$) can be reduced.

In the above embodiment, the GPS sensor is used as a means for detecting the position information of the portable terminal 1. However, the present invention is not limited to this. For a mobile communication network whose cell range is narrow, a cell which is currently managing the portable terminal may be used as position information.

Figure 18:
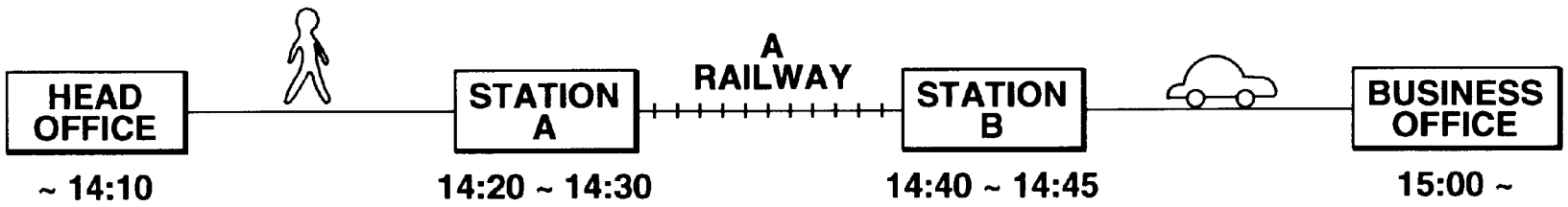
FIG. 18 is a view illustrating the action record of the user who is carrying the portable terminal.

In the above embodiment, the action record table has the form of a timing chart as shown in FIG. 14. However, the present invention is not limited to this. For example, an illustration as shown in FIG. 18 may be used.

In the above embodiment, position information or time information is detected at a predetermined time interval. However, such information need not always be detected at a predetermined time interval. Information may be appropriately sampled a sufficient number of times for action analysis.

In the above embodiment, the action of the user who is carrying the movable terminal is analyzed. However, the arrangement is not limited to the application purpose of detecting the human action. The arrangement can also be applied to survey the action pattern of an animal or check the delivery state of goods.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An action analyzing/recording system wherein information transmitted through a communication control unit of a terminal is analyzed by an information processing unit connected to a network as an action record, data of an analysis result is stored in correspondence with a terminal identification code, and the data is transferred to said terminal as needed, and wherein said terminal comprises a detector for detecting position information and time information, and accumulates the position information and time information detected by said detector, and transmits the accumulated information at once together with the terminal identification code after the accumulated information has reached a predetermined number or predetermined capacity.

2. The system according to claim 1, wherein said information processing unit comprises means for storing map information representing a transport route including a railway line, specifies a name of a region of movement based on the map information and the position information and the time information transmitted from said terminal, and stores the name of the region of movement together with a time.

3. The system according to claim 1, wherein said information processing unit calculates a moving speed from the position information and the time information transmitted from said terminal, and estimates a users' method of movement based on the calculated moving speed.

4. An action analyzing/recording system comprising:

means for detecting position information and time information with respect to a portable terminal;

means for analyzing a moving locus and moving speed of said portable terminal based on the detected position and time information;

means for estimating an action route by specifying a name of a transport facility based on map information and the analyzed moving locus and moving speed; and means for storing information with respect to a place and time of an action as an action record based on the estimated action route.

5. The system according to claim 4, further comprising means for detecting ambient information including sound information, and wherein said estimating means estimates the action route taking into consideration the detected ambient information.

6. An article of manufacture comprising a computer usable medium having computer readable program stored thereon for causing an action to be analyzed and recorded, said computer readable program comprising:

computer readable program code means for causing a computer to detect position information and time information with respect to a portable terminal;

computer readable program code means for causing the computer to analyze a moving locus and moving speed of the portable terminal based on the detected position information and time information;

computer readable program code means for causing the computer to estimate an action route by specifying a name of a transport facility based on map information and the analyzed locus and moving speed; and computer readable program code means for causing the computer to store information with respect to a place and time of an action as an action record based on the estimated action route.

7. An action analyzing/recording system comprising:

a portable terminal having a detector which detects a position of the portable terminal at particular times for generating position and time data of the portable terminal;

a host device having a data processor for processing the position and time data;

a network connecting the portable terminal and the host device and through which the portable terminal transmits the position and time data to the host device; and means for storing route data of predetermined locations associated with a particular type of transport vehicle;

wherein said data processor comprises means for analyzing the position and time data and route data to produce an action record which indicates when and where a user of the portable terminal has been, whether the user has used mechanized transportation to move from one location to another, and if the user has used mechanized transportation, what type of mechanized transportation has been used, based on whether the position data matches the stored route data.

8. The system according to claim 7, wherein:

said system comprises a plurality of portable terminals which transmit respective position data along with respective identification information;

said data processor produces respective action records corresponding to the plurality of portable terminals; and said host device comprises a communication control unit which transmits the action records to the corresponding portable terminals in accordance with the respective identification information.

9. The system according to claim 7, wherein:

said detector of said portable terminal detects positions of said portable terminal plural times to generate plural position data with different timings; and said portable terminal comprises a memory for storing the plural position data, and transmits the plural position data when a remaining capacity of the memory reaches a predetermined limit.

10. The system according to claim 7, wherein said data processor comprises means for storing map information representing a transport route including at least one of a railway and bus line, calculates a moving speed of the user based on the position and time data, and produces the action record by referring to the map information and the calculated moving speed.

11. The system according to claim 10, wherein said portable terminal comprises a transmitter that transmits to the host device the position data of the portable terminal and time information of timings when the position data are obtained.

12. The system according to claim 7, wherein said portable terminal comprises means for detecting ambient sound information and transmits the ambient sound information to the host device, and wherein said data processor analyzes the ambient sound information data to determine where the user was and whether the user walked on foot or used mechanized transportation to move.

13. The system according to claim 7, wherein said host device comprises a transmitter that transmits the action record to the portable terminal.

14. An article of manufacture comprising a computer usable medium having a computer readable program stored thereon for causing an action to be analyzed and recorded, said computer readable program comprising:

computer readable code means for causing a portable terminal having a detector which detects a position of the portable terminal at particular times to generate and transmit position and time data of the portable terminal to a host device via a network;

means for storing route data of predetermined locations associated with a particular type of transport vehicle; and computer readable program code means for causing a data processor of the host device to analyze the position and time data and route data to produce an action record which indicates when and where a user of the portable terminal has been, whether the user has used mechanized transportation to move from one location to another, and if the user has used mechanized transportation, what type of mechanized transportation has been used, based on whether the detected position data matches the stored route data.

* * * * *